United States Patent [19]

Mauro

[11] Patent Number: 4,965,906

[45] Date of Patent: Oct. 30, 1990

[54] COMBINATION GOLF BALL AND CLUB HEAD CLEANER

[76] Inventor: Edward Mauro, 4090 Daventry La., Palm Harbor, Fla. 33563

[21] Appl. No.: 306,426

[22] Filed: Feb. 3, 1989

[51] Int. Cl.[5] ..... B08B 1/00

[52] U.S. Cl. ..... 15/104.92; 15/21 A; 15/21 B; 15/104.94; 15/106; 15/21.2; 15/88.1

[58] Field of Search ..... 15/104.92, 21 A, 21 B, 15/21 D, 104.94, 106

[56] References Cited

U.S. PATENT DOCUMENTS

| | | | |
|---|---|---|---|
| 3,101,497 | 8/1963 | Derkocz | 15/21 A |
| 3,304,659 | 2/1967 | Eichhorn | 15/21 A |
| 3,400,416 | 9/1968 | Nicholson et al. | 15/21 A |
| 3,583,016 | 6/1971 | McConnell | 15/21 A X |
| 4,344,203 | 8/1982 | Gerrick | 15/97 R X |
| 4,380,839 | 4/1983 | Caradonna | 15/21 B X |
| 4,734,952 | 4/1988 | Parchment et al. | 15/21 B X |
| 4,821,358 | 4/1989 | Wyckoff et al. | 15/21 B X |

*Primary Examiner*—Chris K. Moore

*Attorney, Agent, or Firm*—Joseph C. Mason; Ronald E. Smith

[57] ABSTRACT

A combination golf ball and golf club head cleaner that is mounted to the fender of a golf cart or to a conveniently located post. The device includes a water-tight housing member having a first brush-lined cylindrical chamber for cleaning a golf ball and a second brush-lined parallelepiped chamber for cleaning a club head. A ball holder that retains a ball while allowing it to rotate when scrubbed is mounted for reciprocation along its vertical axis in the ball cleaning chamber. Brushes lining the first chamber scrub the ball and rotate it as the holder is reciprocated. The chambers are in fluid communication with one another so that removal of a single plug drains both chambers.

17 Claims, 6 Drawing Sheets

COMBINATION GOLF BALL AND CLUB HEAD CLEANER

TECHNICAL FIELD

This invention relates, generally, to combination cleaning devices. More specifically, it relates to a manually operated device that scrubs golf balls and golf club heads.

BACKGROUND ART

Every golfer knows that playing with a clean ball facilitates better shots, and that a clean club head is equally essential. Most golfers, therefore, start their rounds with clean golf balls and clubs. However, virtually no golf course provides stations on the course where balls and club heads may be cleaned. Accordingly, the game often deteriorates as soon as the ball or club head gets dirty.

A few devices have been designed by inventors to clean golf balls, and a few club head cleaners have been provided as well.

Several devices, such as Warren U.S. Pat. No. 3,748,676, Nicholson U.S. Pat. No. 3,400,416 and Carnahan U.S. Pat. No. 4,350,457 disclose the idea of combining a golf club head cleaner with a ball cleaner. Parchment et al. No. 4,734,952 and Westhoff No. 3,156,000 are of interest for their disclosure of golf club head and golf ball cleaners, respectively, for golf carts and the like. Carleton No. 1,714,346 discloses an annular brush. Frater No. 3,102,291 discloses a vertically movable golf ball cleaner. Hoag No. 3,872,534 and Harkess No. 3,950,810 also disclose golf club head cleaners.

None of the known devices have met with commercial success, since, again, few golf courses, if any, are equipped with the patented devices. Moreover, none of the known devices provide a highly efficient cleaning action. Clearly, there is a need for an efficient, easy to use and inexpensive ball and club head cleaner that could be mounted on golf carts or on posts at convenient locations, but the teachings of the prior art are inadequate to suggest how the need could be filled.

DISCLOSURE OF INVENTION

A water tight housing member having a removable lid is subdivided into two chambers. Water and a suitable cleaning agent are poured into the housing to prepare the unit for use.

A first chamber is cylindrical in configuration and slidably receives therein a pair of flexible pad members disposed in opposing relation to one another. Each pad member carries bristles arrayed in contiguous clusters as in a hair brush so that when the pad members are inserted into the cylindrical chamber, the respective backs of the pads conform to the cylindrical walls thereof and the bristles on the front of the pads collectively extend radially inwardly in a horizontal plane.

A golf ball holder or retainer includes a handle member that surmounts an upstanding plate member that includes a lower portion that includes a tubular member that loosely receives a golf ball. The plate member is slidably mounted with respect to the housing lid member so that manual reciprocation of the handle effects vertical reciprocation of the plate member and hence the ball retained in the tubular member carried by the plate member. As the ball is reciprocated in a vertical plane, it is scrubbed and rotated by the bristles that surround it and thereby cleaned under the chemical action of the cleaning solution as enhanced by the scrubbing action of the brushes. A strong turbulence is created in the ball cleaning chamber, thereby greatly enhancing the efficiency of the cleaning action.

The second chamber, which is in fluid communication with the first, has a parallelepiped configuration. A pair of bristle-carrying pad members are slidably inserted into the second chamber, in overlying relation to facing sidewalls thereof so that the distal free ends of the facing bristles are closely spaced in relation to one another. The bristles scrub a club head as it is immersed in the cleaning solution and manually reciprocated and rotated among the bristles. Flexible flap members cover the second chamber to bar entry of debris thereinto while permitting insertion of the club head.

The device is advantageously provided with means for mounting it to the fender of a golf cart and with means for mounting it to a stationary post. A single drain plug enables both chambers to be drained as needed.

A primary object of this invention is to enhance the game of golf by providing to golfers and golf course owners the answer to the longstanding need for a device capable of cleaning golf balls and club heads that can follow the golfer through the course or that can be mounted near tees.

Another very important object is to provide a highly efficient cleaning device.

Other objects include the provision of a combination golf ball and club head cleaning device that is of elegant construction, low cost and attractive appearance.

A more specific object is to provide, for the first time, a golf ball cleaning apparatus that rotatably mounts a golf ball so that all surfaces of the ball are cleaned quickly but thoroughly upon manual reciprocation of the apparatus so that only a few strokes are needed to clean a golf ball thoroughly and so that the position of the golf ball need not be manually adjusted during the cleaning process.

Other objects will become apparent as this disclosure proceeds.

The invention accordingly comprises the features of construction, combination of elements and arrangement of parts that will be exemplified in the descriptions set forth hereinafter and the scope of the invention will be set forth in the claims.

BRIEF DESCRIPTION OF DRAWINGS

For a fuller understanding of the nature and objects of the invention, reference should be made to the following detailed description, taken in connection with the accompanying drawings, in which.

BEST MODES FOR CARRYING OUT THE INVENTION

Figure 1:
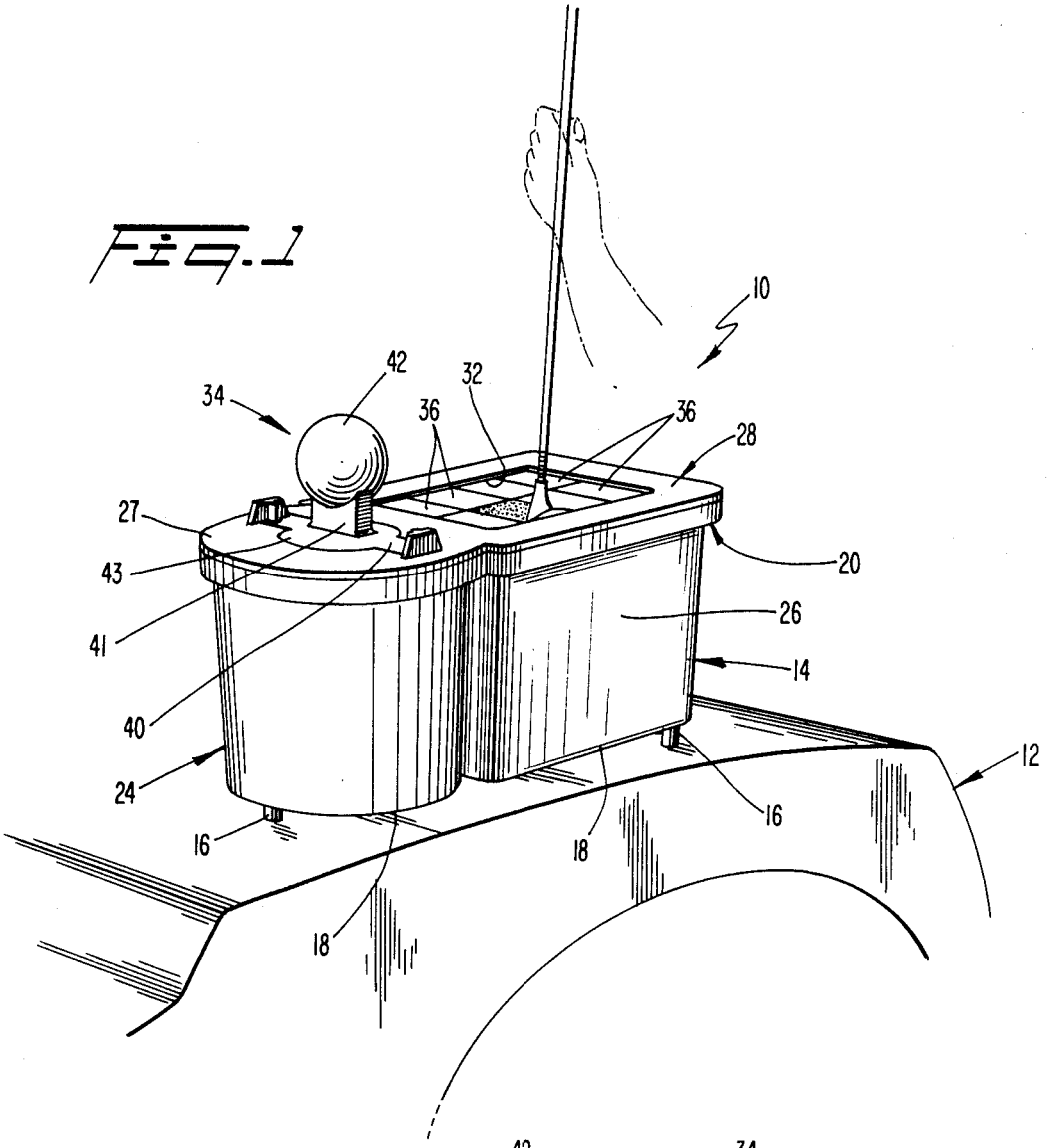
FIG. 1 is a perspective view of a preferred embodiment of this invention mounted on the fender of a golf cart.

Referring now to FIG. 1, it will there be seen that a device that illustratively embodies the present invention is denoted as a whole by the reference numeral 10; it is shown mounted on a golf cart fender 12.

The novel device 10, known commercially as the Golf Clean (for complete control) (TM), includes a water-tight housing, generally denoted 14, that is maintained in vertically spaced relation to the top of fender 12 by plural truncate leg members 16. Each leg member 16 has its uppermost end suitably secured to the flat imperforate bottom wall 18 of housing 14 and is internally threaded so that it may be secured to fender 12 by screws or other suitable fastening means.

Accordingly, device 10 is mountable to a fender 12 in the absence of any mounting holes being formed in bottom wall 18 of housing 14. Thus, device 10 is leak-proof when filled with water and a cleaning agent. Importantly, the device is universal in that it fits any golf cart fender manufactured. Suitable shims are used in some cases.

The height of legs 16 is preselected to allow ample clearance between bottom wall 18 and fender 12 so that leaves and other debris that might collect under the device may be easily swept away with a garden hose, and so that the fender may be cleaned, thoroughly, as needed.

Housing 14 has two primary sub-housings. Sub-housing or ball housing 24 houses the components that clean golf balls and sub-housing or club head housing 26 houses the components that clean club heads. Ball housing 24 is defined by generally cylindrical upstanding sidewalls, as shown, whereas club head housing 26 has a parallelepiped configuration. Both sub-housings are closed by a closure means in the form of an integrally formed lid member 28 which is specifically configured and dimensioned to releasably but securely engage the overhanging uppermost edge of the sidewalls of each sub-housing as depicted; the overhang is denoted 20.

The part 27 of lid member 28 that closes ball housing 24 is slotted as at 30 (FIG. 3) whereas the part 29 thereof that closes club head housing 26 has a large, generally rectangular opening 32.

Slot 30 slidably receives the novel ball cleaning apparatus, generally denoted 34 in FIG. 1; rectangular opening 32 receives the club head to be cleaned when device 10 is used as depicted in FIG. 1 and opening 32 is closed by plural, flexible flap members that are collectively denoted 36.

Figure 2:
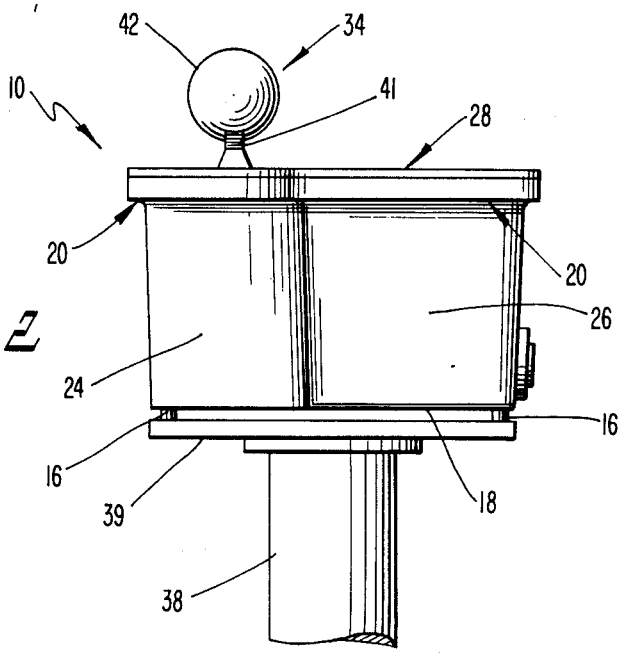
FIG. 2 is a side elevational view of the device shown in FIG. 1 mounted on a stationary post member positioned near a golf tee.

FIG. 2 depicts device 10 when mounted on a post 38 and a board or other suitable support surface 39. Golf course owners may mount a device 10 to one or more posts near some or all of the teeing areas of a golf course, may provide all of their golf carts with fender-mounted devices, or may choose to make the device available both ways to maximize the convenience to players.

Figure 3:
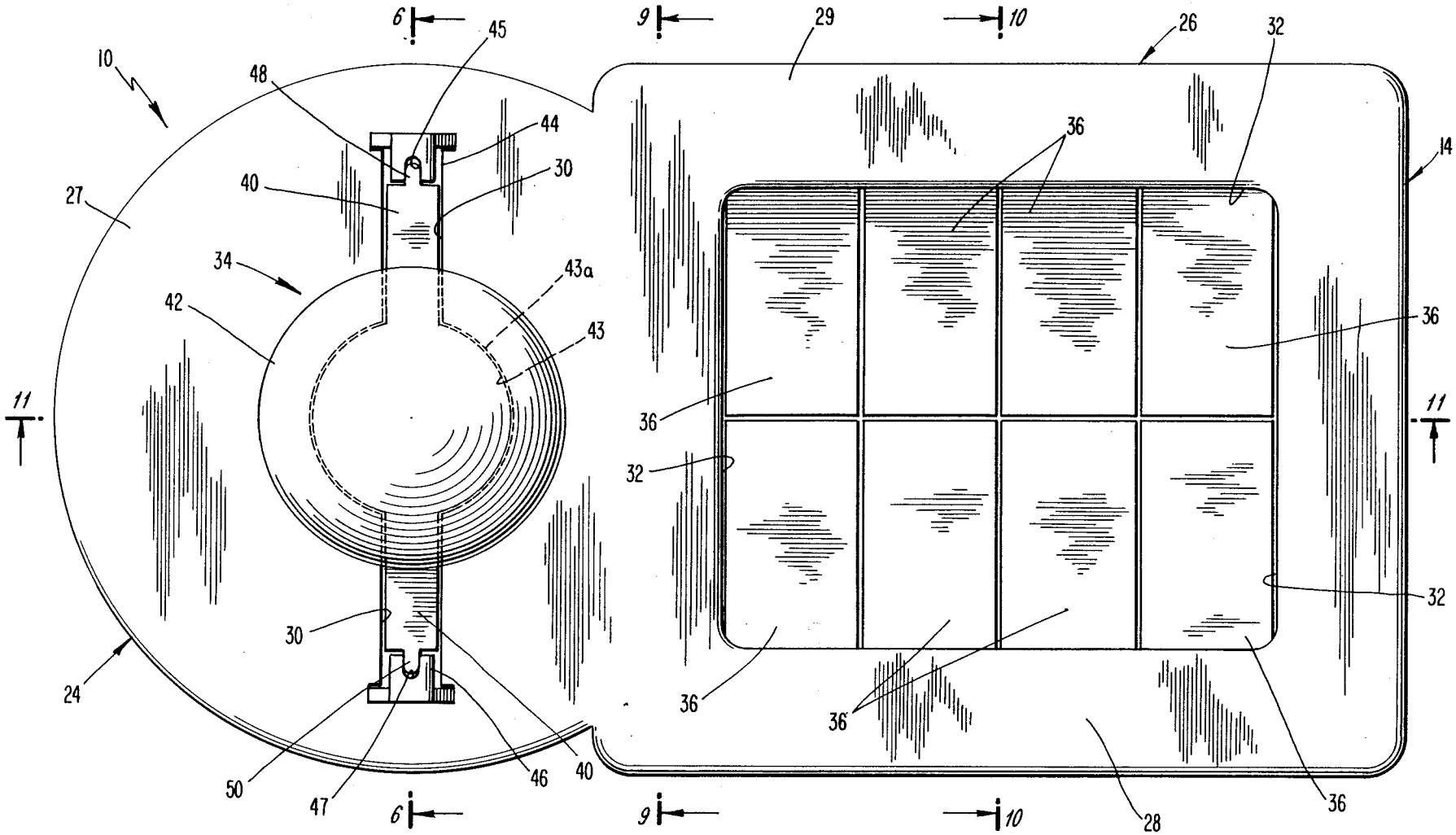
FIG. 3 is a top plan view of the device shown in FIGS. 1 and 2.

Additional structural details of device 10 are shown in FIG. 3.

Ball cleaning apparatus 34 includes a generally flat, planar-in-configuration plate member 40 having a main body portion that conforms in size and shape to slot 30; plate 40 is vertically reciprocal in slot 30 in a manner explained below.

Figure 6:
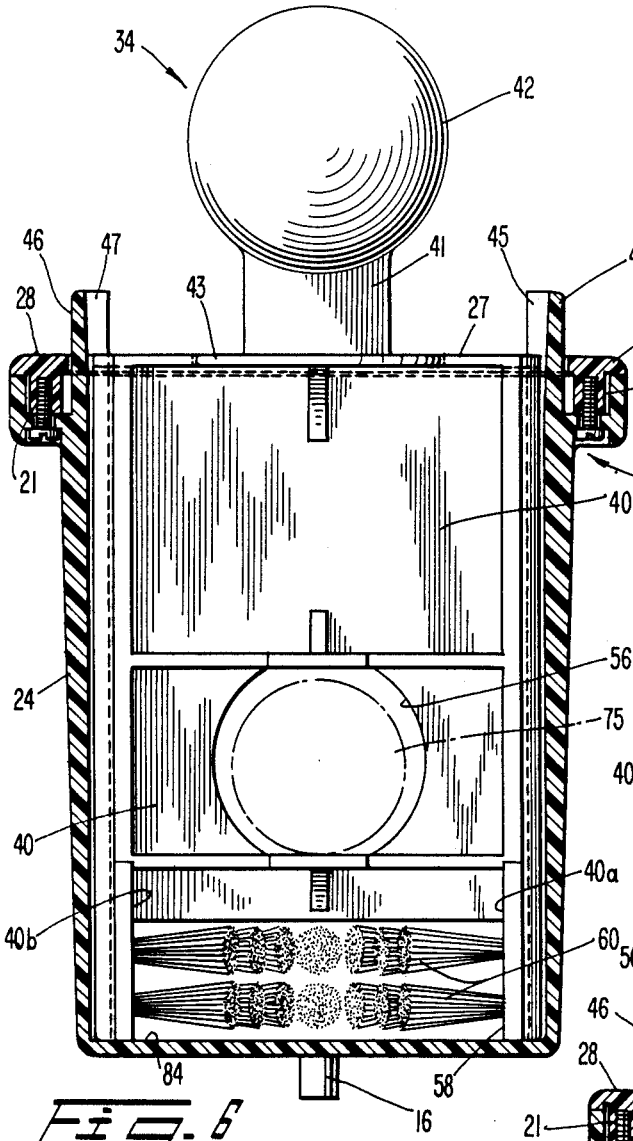
FIG. 6 is a sectional view taken along line 6—6 in FIG. 3.
Figure 7:
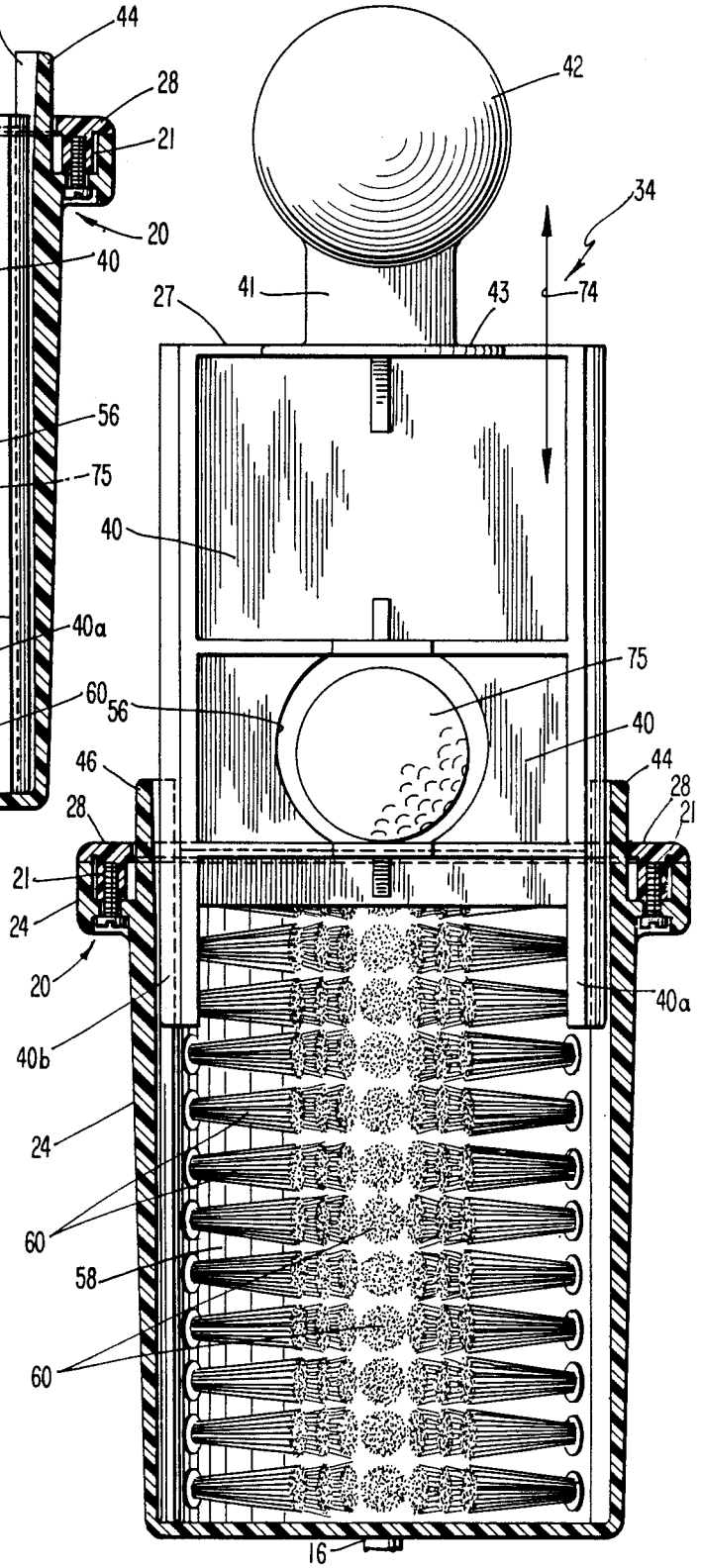
FIG. 7 is a sectional view similar to FIG. 6 but showing the uppermost limit of travel of the ball retainer.

A preferably spherical-in-configuration handle member 42 surmounts a neck member 41 that is integral to plate 40 as perhaps best understood in connection with FIGS. 1, 6 and 7. Thus, manual oscillation of plate 40 in a vertical plane is accomplished through manipulation of handle 42. Circular plate member 43 (FIG. 3) is flush with lid surface 27 and is received within circular recess 43*a* formed therein when handle 42 is in its down position.

A pair of truncate boss members 44, 46 are integral with lid member 28 and project upwardly therefrom to serve as guide means for plate 40 during its vertical reciprocation. Each boss member 44, 46 has an inwardly facing, vertically extending groove 45, 47 formed along its extent, respectively, to slidably receive and guide a complementally formed, associated tongue member 48, 50 integral to the edges of plate member 40, as perhaps best shown in FIG. 3.

Figure 4:
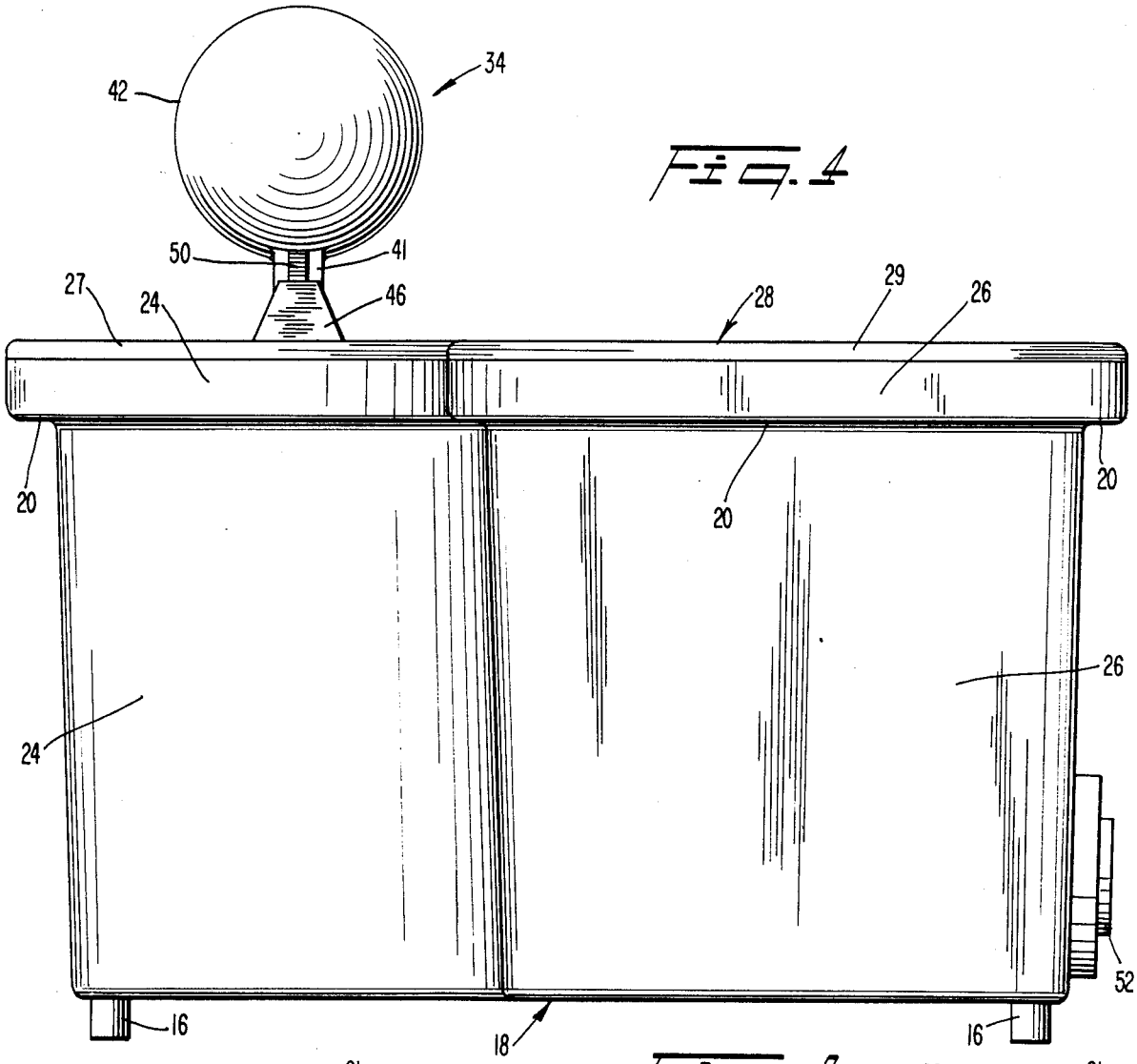
FIG. 4 is a side elevational view thereof.

Boss member 46 and tongue 50 are shown in side elevation in FIG. 4. Drain plug 52 is also shown in FIG. 4 at the lower right-hand corner thereof.

Figure 5:
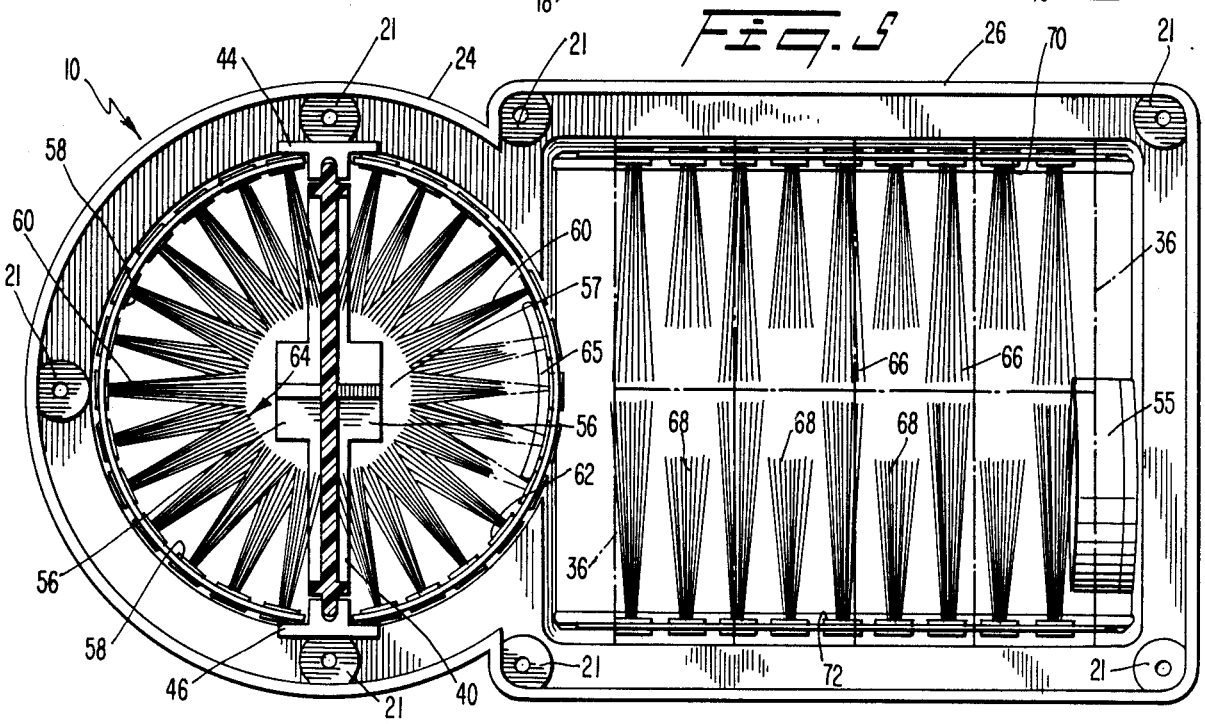
FIG. 5 is a top plan view thereof with the lid removed.

Plate 40 is shown in still greater detail in FIG. 5, 6 and 7; it will there be seen that a generally tubular golf ball retainer means or retention member 56 is formed therein, equidistantly between the lateral edges of plate 40.

Figure 11:
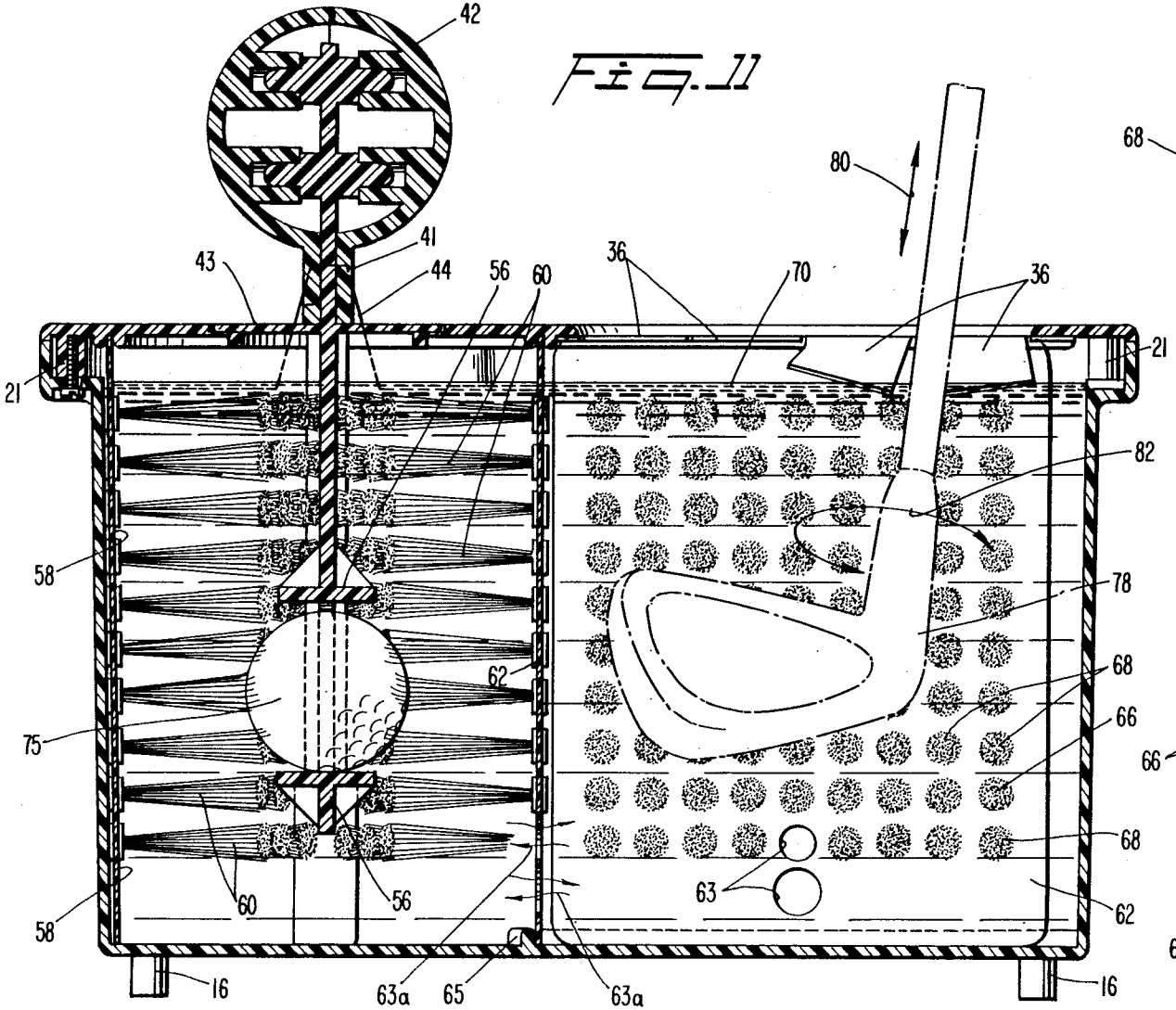
FIG. 11 is a sectional view taken along line 11—11 in FIG. 3.

The longitudinal axis of symmetry 57 of retention member 56 is coincident with the longitudinal axis of symmetry of device 10. The diameter of retention member 56 is greater than the diameter of a golf ball, and the length thereof is less than the diameter of a golf ball, as shown in FIG. 11.

A first flexible pad member 58 (FIG. 5) is slidably received in ball housing 24; plural bunched bristles, collectively denoted 60, are fixedly anchored in pad member 58 throughout the breadth and extent thereof as in a conventional hair brush. The arcuate extent of pad member 58 is sufficient to overlie about half the cylindrical chamber defined by ball housing 24, as shown. A second flexible pad member 62 of the same construction has an arcuate extent sufficient to overlie the other half of the cylindrical chamber and bristles 60 extend therefrom in the same way.

All of the bristles 60 are of the same length; thus, their respective distal free ends collectively form the boundary of a tubular cavity 64 that provides a clearance space for ball retainer 56 when it undergoes vertical reciprocation as best shown in FIG. 5.

The bristles in club head housing 26 are not all of the same length; bristles 66 are elongate and bristles 68 are truncate, as shown in FIG. 5. Bristles 66, 68 are mounted to flexible pad members 70, 72 that overlie facing interior sidewalls of club housing 26, as shown.

Figure 9:
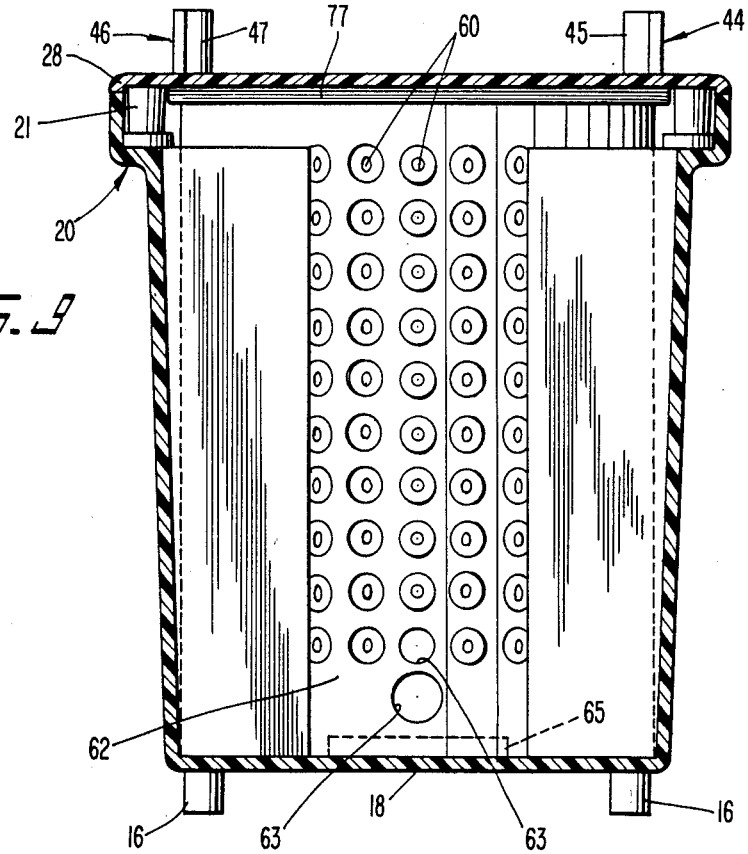
FIG. 9 is a sectional view taken along line 9—9 in FIG. 3.
Figure 12:
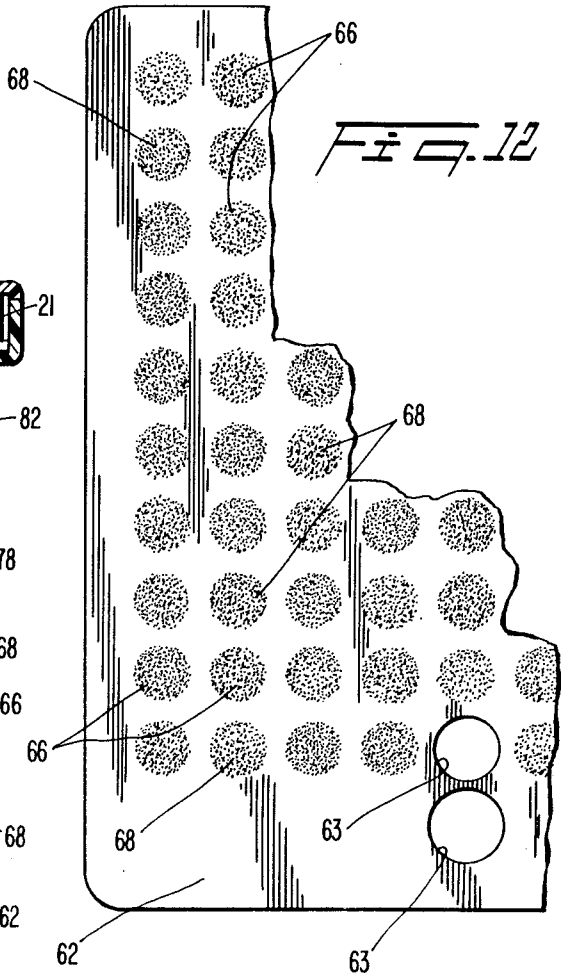
FIG. 12 is a broken away view of a bristle-carrying pad member of the type employed in the present invention.

The respective interiors of the golf ball cleaning housing 24 and club head cleaning housing 26 are confluent with one another so that the charging of water and a cleaning agent into either interior chamber will fill the other chamber as well. Pad member 62 of ball cleaning chamber 24 is apertured near its base as indicated in FIGS. 9 and 12 by the reference numeral 63 to provide the desired fluid communication. Reference numeral 63*a* (FIG. 11) denotes directional arrows that indicate the fluid communication between the ball cleaning chamber 24 and the club head cleaning chamber 26.

Detent member 65, shown near the bottom of FIGS. 9 and 11, is also shown in FIG. 5 and its position is perhaps best understood in connection with FIG. 5. The function of detent member 65 is to maintain the lower end of pad member 62 in its operative configuration as best depicted in FIG. 5.

Figure 10:
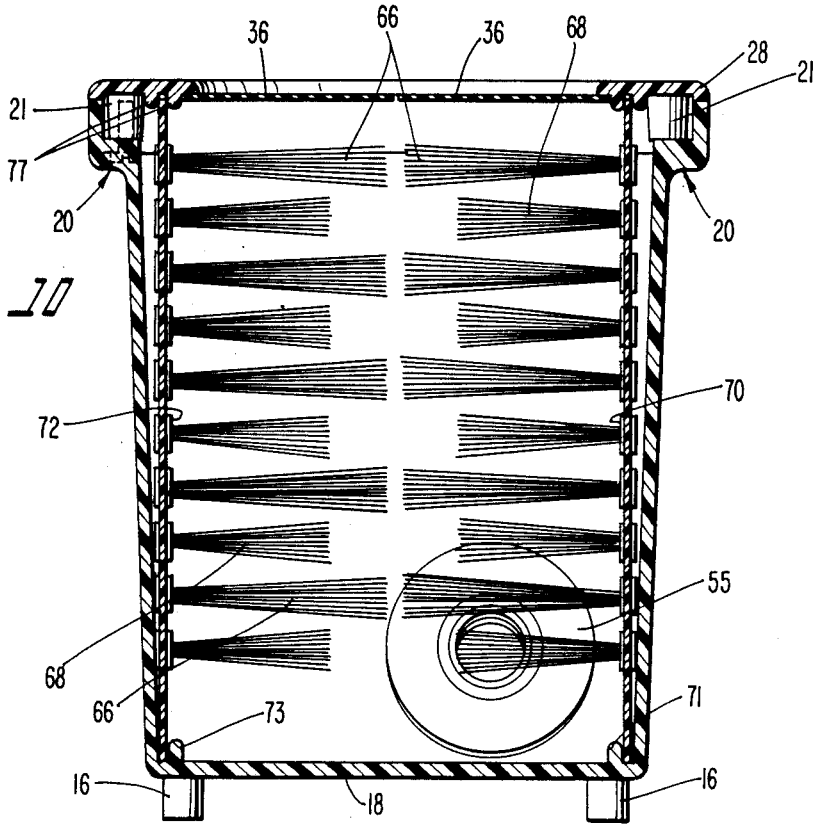
FIG. 10 is a sectional view taken along line 10—10 in FIG. 3.

Similar detent members 71, 73 (FIG. 10) serve to maintain the lower ends of pad members 70, 72 in position. The uppermost ends of the pad members are received between elongate detent members 75, 77 that extend along the peripheral boundary of lid member 28 as shown in FIG. 10.

Figure 8:
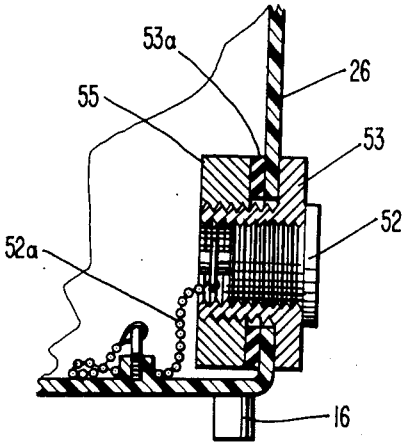
FIG. 8 is a sectional view of the preferred drain plug means.

FIG. 8 depicts the drain plug assembly 52 in section. An aperture is formed in the wall of club head housing 26, as shown, and a plug-receiving, complementally threaded socket member 53 is positioned therein. A suitable sealing means 53*a* is tightly compressed by a nut means 55 to insure against water leakage in conventional fashion. A suitably anchored chain 52*a* is disposed interiorly of housing 26 to avoid loss of plug 52.

The manner in which a ball is cleaned is perhaps best understood in connection with FIGS. 6 and 7, which Figs. show the "down" and "up" positions of the ball retainer assembly 34, respectively, as indicated by the double-headed directional arrow 74 in FIG. 7. A ball 75 (FIG. 7) is positioned in the tubular ball retainer 56 when handle member 42 is in its "up" position; handle 42 is then reciprocated.

It should be noted that the main body portion of flat plate member 40 does not extend to the bottom of ball housing 24; instead, a pair of laterally disposed leg members 40*a*, 40*b* abut bottom wall 18 of device 10 as shown in FIG. 6 to limit the downward stroke of the handle 42. The cavity 84 bounded by bottom wall 18, legs 40*a* and 40*b* and plate 40 performs an important role in the cleaning of golf balls because the downward stroke of plate member 40 creates a substantial amount of turbulence in cavity 84. The size of cavity 84 changes as handle 42 is reciprocated, so the cleaning solution is churned vigorously as plate 40 oscillates upwardly and downwardly. Thus, only a few oscillations are required to clean even the dirtiest of golf balls.

The golf ball cleaners of the prior art include no means for creating turbulence in the cleaning solution, nor do they provide retainers such as retention member 56 or radially disposed brushes 60. Thus, prior art devices require that after a ball has been scrubbed for a while in a first position, it must be removed from its holder and rotated manually to expose additional dirty surfaces to a brush or brushes. The need to interrupt the ball-cleaning procedure to manually reposition the ball as needed is believed to be one of the shortcomings of earlier inventions in this field responsible for their lack of acceptance in the marketplace.

The means whereby lid 28 is secured to overhang 20 is also shown in FIGS. 6 and 7. Overhang 20 circumscribes device 10 as shown in several of the Figs.; screw-receiving countersunk areas are provided at spaced intervals along the extent thereof as best shown in FIGS. 6 and 7. Base members 21 are integrally formed with and depend from lid 28 and are internally threaded to receive screws therein as shown to complete the assembly. The preferred placement of the base members 21 and hence of the screws is best shown in FIG. 5.

As best understood in connection with FIG. 11, the radially innermost ends of bristles 60 brush all of the surfaces of ball 75 when handle 42 is reciprocated. The diameter of tubular ball retention member 56 is greater than the diameter of ball 75 and the length of retention member 56 is less than the diameter of the ball; this results in rotation of ball 75 as it travels upwardly and downwardly along the extent of its path of travel.

FIG. 11 shows how a golf club head 78 is reciprocated and rotated as suggested by the double-headed directional arrows 80 and 82, respectfully.

INDUSTRIAL APPLICABILITY

There are thousands of golf courses and millions of golfers worldwide. However, heretofore there have been virtually no commercially acceptable golf ball or golf club head cleaners available for use by course owners or players. Thus, the present invention will have a significant impact on the game of golf. It has the ability to clean the grooves in the club head; this allows the golfer to impart a better backspin to the ball. A clean ball also interacts optimally with a clean club head. Thus, the invention gives the golfer complete control over the shot.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, What is claimed is:

1. A device that cleans golf balls; comprising:

a first cleaning chamber having cylindrical sidewalls;

said first cleaning chamber having a plurality of horizontally disposed bristle members that extend radially inwardly relative to said sidewalls, said bristle members extending substantially from a top part of said cleaning chamber to a bottom part thereof;

a flexible pad member from which said bristle members extend;

a generally tubular in configuration golf ball retention member;

said retention member having a diameter greater than a golf ball's diameter;

said retention member having a length less than a golf balls' diameter;

a substantially cylindrical cavity being collectively defined by radially innermost ends of said bristle members;

said cylindrical cavity having a diameter greater than the length of said retention member;

said cylindrical cavity having a diameter less than the diameter of a golf ball;

a plate member that carries said retention member;

a handle means being fixedly secured to said plate member in surmounting relation thereto;

a second cleaning chamber;

said second cleaning chamber having a first plurality of horizontally disposed bristle members disposed therein, extending in a first common direction;

said second cleaning chamber having a second plurality of horizontally disposed bristle members disposed therein, extending in a second common direction opposite to said first direction;

opposing ends of said first and second plurality of bristle members being in closely spaced juxtaposition to one another so that a golf club head is insertable therebetween;

means bringing said first and second cleaning chambers into fluid communication with one another;

said means being an aperture means formed in said pad member.

2. A device that cleans golf balls and golf club heads, comprising:

a first open-topped cleaning chamber for cleaning golf balls, said first cleaning chamber having cylindrical side walls;

at least one flexible pad member disposed in at least partially overlying relation to said cylindrical side walls;

a first plurality of bristles being mounted on said at least one pad member and extending radially inwardly therefrom;

means for moving a golf ball in relation to said first plurality of bristles;

a second open-topped cleaning chamber for cleaning golf club heads, said second cleaning chamber having a generally parallelepiped configuration;

a lid for capping said first and second cleaning chambers;

a pair of flexible pad members being disposed in overlying relation to preselected side walls of said second cleaning chamber, in confronting relation to one another;

a second plurality of bristles being mounted on associated pad members of said pair of pad members and confronting groups of said second plurality of bristles extending toward one another so that both sides of a golf club head reciprocated therebetween are brushed thereby; and said first and second cleaning chambers being in fluid communication with one another;

a predetermined pad member disposed within said device being apertured to provide said fluid communication.

3. The device of claim 2, wherein said at least one pad member disposed in said first cleaning chamber is apertured to provide said fluid communication.

4. The device of claim 3, further comprising:

a generally tubular in configuration golf ball retention member;

said retention member having a diameter greater than a golf ball's diameter;

said retention member having a length less than a golf ball's diameter;

a substantially cylindrical cavity being collectively defined by radially innermost ends of said first plurality of bristles;

said cylindrical cavity having a diameter greater than the length of said retention member;

said cylindrical cavity having a diameter less than the diameter of a golf ball;

a plate member that carries said retention member;

a handle secured to and disposed in surmounting relation to said plate member;

said retention member, plate member and handle collectively providing said means for moving said golf ball in relation to said first plurality of bristles;

whereby said first plurality of bristles scrubs and rotates a golf ball disposed within said retention member when said handle is reciprocated.

5. The device of claim 4, further comprising:

a pair of leg members that depend from laterally opposite ends of a main body part of said plate member, said leg members abutting a bottom all of said first cleaning chamber when said handle is in its lowermost position and the length of said leg members determining the amount of space between said first cleaning chamber bottom wall and a lowermost end of said plate member main body part;

whereby reciprocation of said plate member creates substantial turbulence in cleaning solution charged into said first cleaning chamber.

6. The device of claim 5, further comprising:

a first opening formed in said lid for receiving the retention member carried by said plate member so that a golf ball to be cleaned is insertable into said retention member and removable therefrom after cleaning.

7. The device of claim 6, further comprising:

a secondary closure means for closing said first opening formed in said lid;

said secondary closure means being disposed between said handle and said plate member;

said secondary closure means closing said first opening formed in said lid only when said handle is in a lowermost position.

8. The device of claim 7, further comprising a pair of diametrically opposed slots formed in said lid in open communication with said first opening, said slots being configured and dimensioned to slidably receive opposite edges of said plate member.

9. The device of claim 8, further comprising:

a second opening formed in said lid for receiving a golf club head member into said second cleaning chamber;

a secondary closure means for closing the second opening formed in said lid;

said secondary closure means including a plurality of horizontally disposed flexible flap members that collectively close said second opening in said lid when said flap members are in repose, said flap members being transiently displaceable to permit insertion of a golf club head member into said second cleaning chamber.

10. The device of claim 9, wherein said at least one flexible pad member includes a pair of pad members each of which overlies about half the circumferential extent of said first cleaning chamber.

11. The device of claim 10, further comprising:

first detent means formed on a bottom side of said lid, along the peripheral edges thereof, for releasably engaging uppermost ends of the respective pad members to which the bristles of the first and second cleaning chambers are secured.

12. The device of claim 11, wherein said first and second cleaning chambers share a common, imperforate bottom wall.

13. The device of claim 12, further comprising:

second detent means integral to said imperforate bottom wall, operative to releasably engage lowermost ends of the respective pad members to which the bristles of the first and second cleaning chambers are secured;

whereby worn bristles are replaced by removing said lid, separating the respective pad members from said first and second detent means and introducing new pad members into their respective chambers and engaging their respective lowermost ends with said second detent means, reclosing said lid and substantially simultaneously engaging uppermost ends of said pad members into said first detent means.

14. The device of claim 13, further comprising:

a plurality of truncate leg members secured to said imperforate bottom wall in depending relation thereto;

each of said leg members being threaded to receive a screw member thereinto so that the device is selectively securable to a golf cart fender and to a support member that surmounts an upstanding post.

15. The device of claim 14, further comprising:

a drain opening formed in a side wall of said device;

a drain plug member for selectively opening and closing said drain opening;

a flexible chain that interconnects said drain plug member and said housing member; and said chain being disposed interiorly of said device.

16. The device of claim 15, wherein an overhang is formed along the uppermost extent of said device and wherein a plurality of countersunk recesses are formed at preselected locations along the extent of said overhang so that screw members that secure said lid to said overhang are substantially hidden from view.

17. The device of claim 16, further comprising a pair of boss members surmounting said lid in juxtaposition with laterally opposite edges of said plate member and wherein each of said boss members has a groove formed therein, wherein complementally formed tongue members ar formed in longitudinally opposite edges of said plate member, whereby said boss members facilitate reciprocation of said plate member when a golf ball is being cleaned.

* * * * *